US006145766A

United States Patent [19]

Mraz et al.

[11] Patent Number: 6,145,766

[45] Date of Patent: Nov. 14, 2000

[54] SCREW DEVICE FOR DEWATERING AND DEFIBRATING LIGNO-CELLULOSE MATERIAL

[75] Inventors: Peter Mraz, Klosterneuberg; Heinrich Münster, Vienna, both of Austria

[73] Assignee: Andritz-Patentverwaltungs-Gesellschaft m.b.H., Graz, Austria

[21] Appl. No.: 09/022,776

[22] Filed: Feb. 12, 1998

[30] Foreign Application Priority Data

Feb. 14, 1997 [AT] Austria ..... 245/97

[51] Int. Cl.[7] ..... B02C 19/22

[52] U.S. Cl. ..... 241/74; 241/79; 241/260.1

[58] Field of Search ..... 241/260.1, 74, 241/79, 247

[56] References Cited

U.S. PATENT DOCUMENTS

| | | | |
|---|---|---|---|
| 4,457,804 | 7/1984 | Reinhall | 241/247 X |
| 4,566,640 | 1/1986 | McFarland et al. | 241/74 |
| 4,836,460 | 6/1989 | Akazawa | 241/247 |
| 4,838,995 | 6/1989 | Klausen | 162/18 |
| 4,908,101 | 3/1990 | Frisk et al. | 162/261 |
| 5,156,872 | 10/1992 | Lee | 426/489 |
| 5,381,730 | 1/1995 | Kim | 241/260.1 X |
| 5,577,674 | 11/1996 | Altonji et al. | 241/46.15 |

FOREIGN PATENT DOCUMENTS

| | | | |
|---|---|---|---|
| WO 92/13710 | 8/1992 | WIPO | B30B 9/14 |

*Primary Examiner*—John M. Husar
*Attorney, Agent, or Firm*—Alix, Yale & Ristas, LLP

[57] ABSTRACT

The invention relates to a device for dewatering and defibrating ligno-cellulose material using a screw. It is primarily characterized by a defibrating element (9) directly adjoining the body (2') of a first screw.

28 Claims, 4 Drawing Sheets

SCREW DEVICE FOR DEWATERING AND DEFIBRATING LIGNO-CELLULOSE MATERIAL

BACKGROUND OF THE INVENTION

The invention relates to equipment for dewatering and defibrating ligno-cellulose material using a screw.

Conventionally, screw presses or plug feeders have been used to dewater wood chips or other ligno-cellulose material. In these devices, the material is primarily compressed, during which process it is defibrated to some extent and dewatered. In order to achieve better dewatering, the material must be defibrated further, which is often achieved with two intermeshing double screws or single screw with discontinuous screw flights and shearing pins. Controlled defibrating is not possible on these machines; thus the dewatering capacity is also limited.

SUMMARY OF THE INVENTION

The present invention provides controlled defibrating and optimum dewatering results.

According to the invention, a defibrating element directly adjoins the body of a first screw. Controlled defibrating is made possible by this special defibrating element.

A favorable further development of the invention is characterized by the defibrating element having a conical shape. With this conical design, the pressure build up is improved and thus, better dewatering is achieved.

An advantageous configuration of the invention is characterized by the defibrating element containing ribs, where the ribs are mounted at an angle to the screw axis. With the defibrating ribs, defibrating can be controlled even more effectively and some conveying effect also achieved at the same time.

A favorable further development of the invention is characterized by the conical defibrating element being surrounded by a conical casing, where the conical casing can have internal ribs which advantageously form an angle to the screw axis. The combination of conical defibrating element and conical casing provides a defined, constant gap through which the material is conveyed or pressed. Thus, it is possible to control defibrating even more effectively.

A favorable configuration of the invention is characterized by a movable defibrating element which can be displaced in axial direction or alternatively, a conical casing that can be moved in axial direction. Since either the defibrating element or the casing can be displaced, the gap can be set while the machine is in operation.

An advantageous further development of the invention is characterized by the conical casing having openings, for example drilled holes or slits, for the liquid to drain off. In this way, more liquid can be removed in this part of the machine.

A favorable configuration of the invention is characterized by a further screw adjoining the defibrating element. This is used to further compress the material and achieve even better dewatering.

An advantageous further development of the invention is characterized by the shaft of the further screw containing drill holes which are connected to a hole drilled through the center of this shaft, where the hole in the center of this shaft continues through the defibrating element to the shaft of the first screw and can be connected to openings in this shaft. As a result, the steam which builds up in the final section can be used conveniently to pre-heat the material.

An alternative configuration of the invention is characterized by a pressure casing being mounted over the further screw, the defibrating element and the end of the first screw, where the pressure casing can be connected to a pipe containing a device to pre-heat the material. Thus, the material can be pre-heated before entering the device as a whole.

A further alternative configuration is characterized by the defibrating element and/or the conical casing containing grooves to re-circulate the steam.

In this way, the steam can be used directly for pre-heating in the screw section without any great steam losses.

BRIEF DESCRIPTION OF THE DRAWINGS

The preferred embodiments of the invention are described below in examples and with reference to the accompanying drawings, wherein.

DESCRIPTION OF THE PREFERRED EMBODIMENTS

Figure 1:
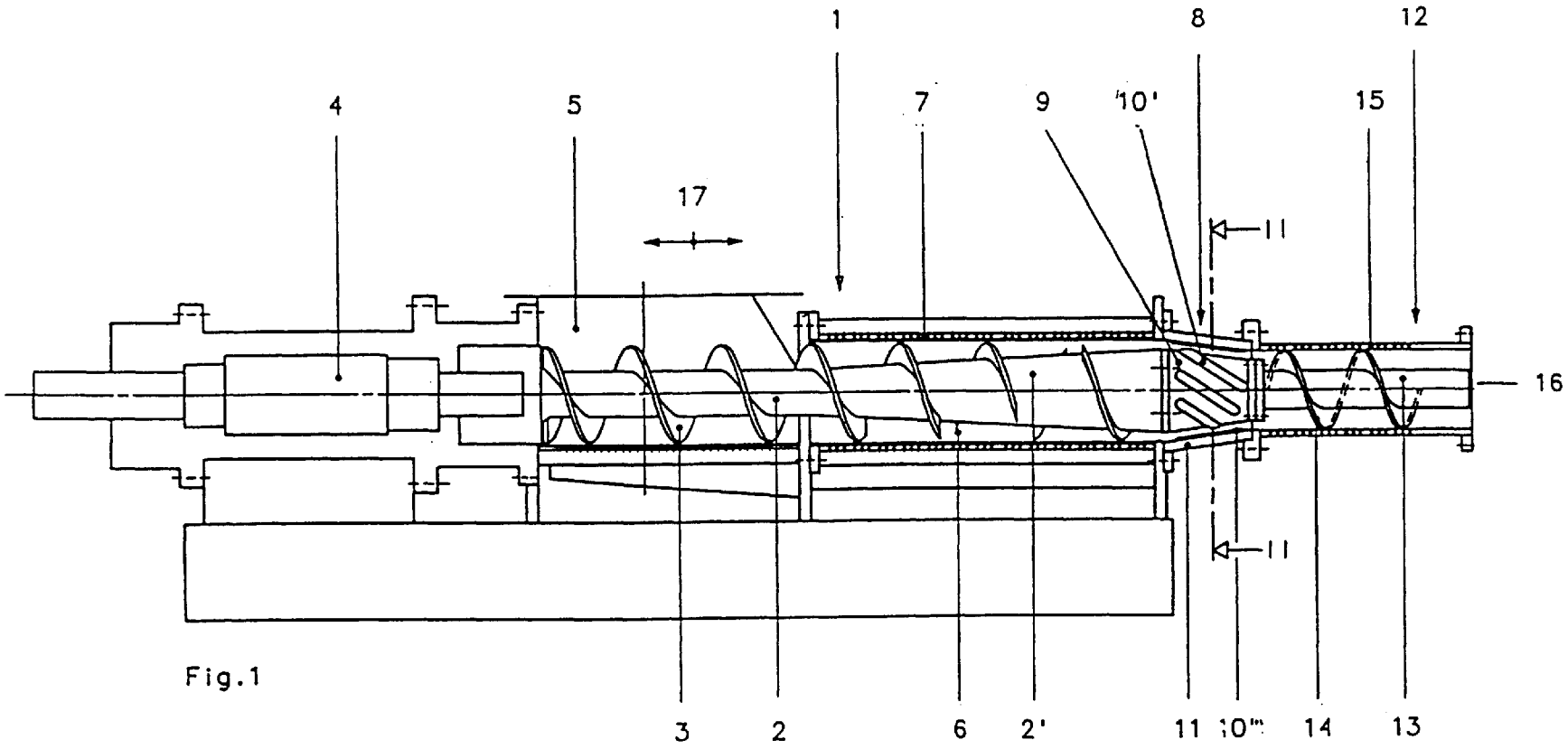
FIG. 1 shows a section through a device for dewatering and defibrating according to the invention.

FIG. 1 shows a device 1 according to the invention with a screw shaft or body 2 and screw flighting 3, where the shaft 2 is driven via the drive shaft 4. The material to be dewatered, such as wood chips, is fed into the screw 3 through an input opening 5. In the dewatering section 6 adjoining the inlet area, the diameter of the screw shaft 2' increases continuously in order to thus reduce the flow cross-section and generate higher pressure for dewatering. In this section, the screw shaft 2' is surrounded by a screen casing 7 through which the water can drain off. The material in its compacted condition at the maximum diameter of the screw shaft 2' directly enters the defibrating section 8 without expansion, and remains in a highly compacted condition as it passes through the defibrating section. The defibrating section 8 adjoins this dewatering section 6. Here, a cone 9, which is rigidly connected to the screw shaft 2' and fitted with conveyordefibrator ribs 10', rotates in a conical shell 11, which also has defibrating ribs 10" on the side of the shell facing the cone. The diameter of the defibrating cone 9 decreases in the direction of material flow. As shown in FIG. 1, a further dewatering section 12 adjoins this defibrating section 8. In this further dewatering section, a second screw shaft 13 rigidly extends from the defibrating element 9. The screw flighting 14 presses more liquid out of the loosened and partly defibrated material, with the water draining off through the openings in the screen shell 15. At the exit end 16, the device can be connected, for example, to a material silo, where the material plugs formed at the exit end, prevent any steam that may be in the silo from escaping back into flighting 14. The entire screw unit (shaft 2,2' , cone 9, shaft 13) can be built such that it can be moved in the direction of the arrow 17. Thus, the gap between the cone 9 and the conical shell 11, and with it the degree of compaction and thus the defibrating efficiency, can be carefully set and controlled.

Figure 2:
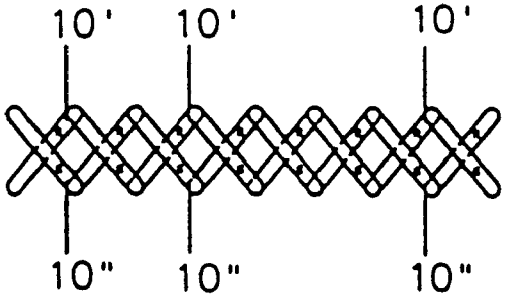
FIG. 2, 2*a*), 2*b*) contains a section through the line II—II in FIG. 1.
Figure 2:
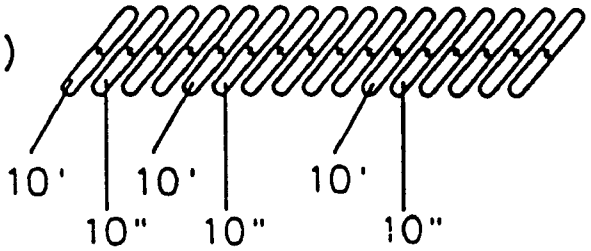
Figure 2:
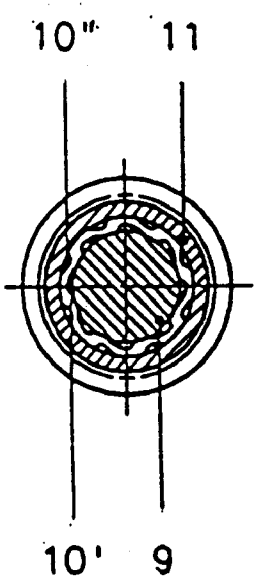

FIG. 2 shows a section through the line II—II in FIG. 1. Here, the defibrating ribs 10' on the cone 9 and the defibrating ribs 10" on the conical shell 11 are shown clearly. FIGS. 2*a* and 2*b* show a developed view of possible patterns for the defibrating ribs 10' and 10". The crossing rib pattern in FIG. 2*a* generates a greater shearing effect and thus, better defibration, while the obliquely parallel pattern in FIG. 2*b* provides better loosening of fibers and conveying of the material. Thus, the more suitable design can be selected depending on the application and requirements.

Figure 3:
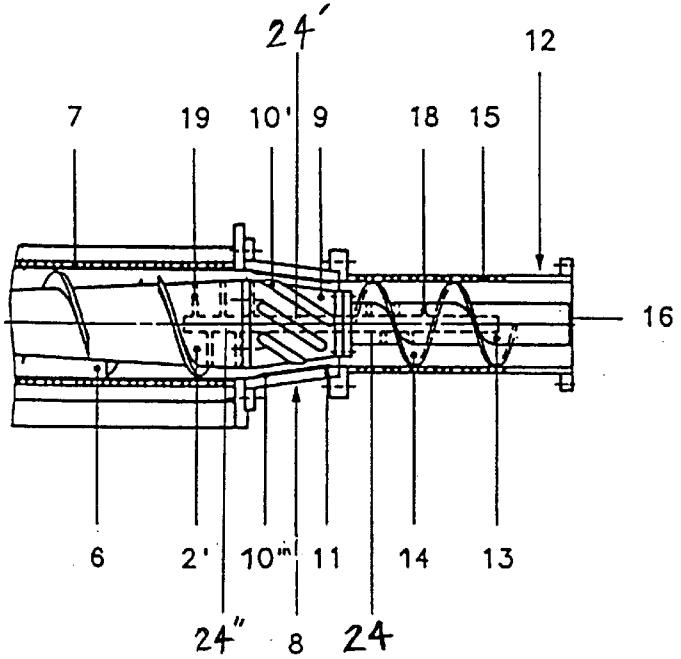
FIG. 3 shows a detail from the area around the defibrating element with internal steam recirculation.

FIG. 3 illustrates a variant of the invention where the steam generated by the pressure is fed through bore holes 18 at the shaft surface into a hole 24 drilled as a blind bore into the center of the shaft 13 of the further screw. This bore hole 24 connects with central bores 24',24" which run through the cone 9 into the shaft 2' in the dewatering section 6 of the first screw, from where the steam is fed through appropriate bore holes 19 into the material, which is under lower pressure than in dewatering section 12, thus pre-heating the material. This results in better dewaterability in the dewatering zone 6 and the temperature causes the fiber bundles to break down, which leads to lower energy consumption for defibrating.

Figure 4:
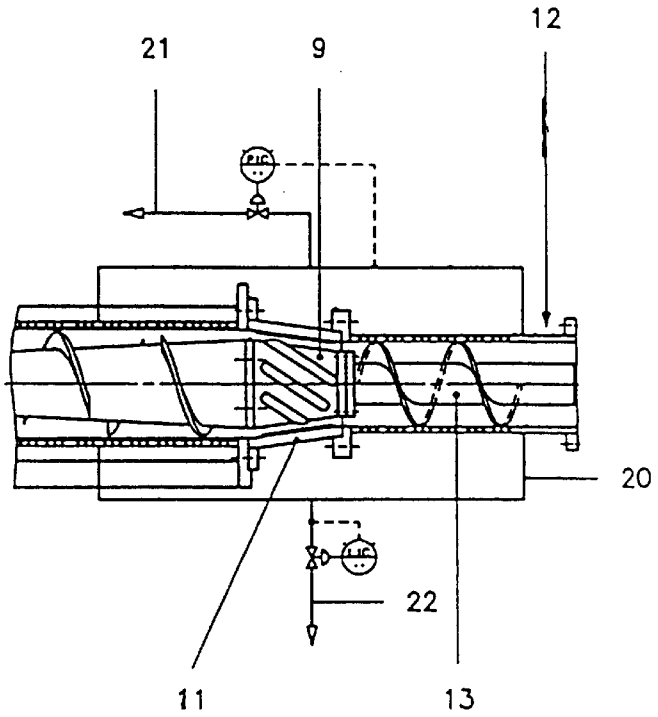
FIG. 4 contains the same detail with external steam recirculation for external pre-heating.

FIG. 4 shows an alternative to the arrangement in FIG. 3, where the steam generated here is collected in a pressure casing 20 mounted above the area containing the further screw 13,14, the defibrating element 9 and the end of the first screw, and then fed through a pipe 21 to pre-heat material before it enters the overall device. The water squeezed out of the material is drained out of the pressure casing 20 through a pipe 22.

Figure 5:
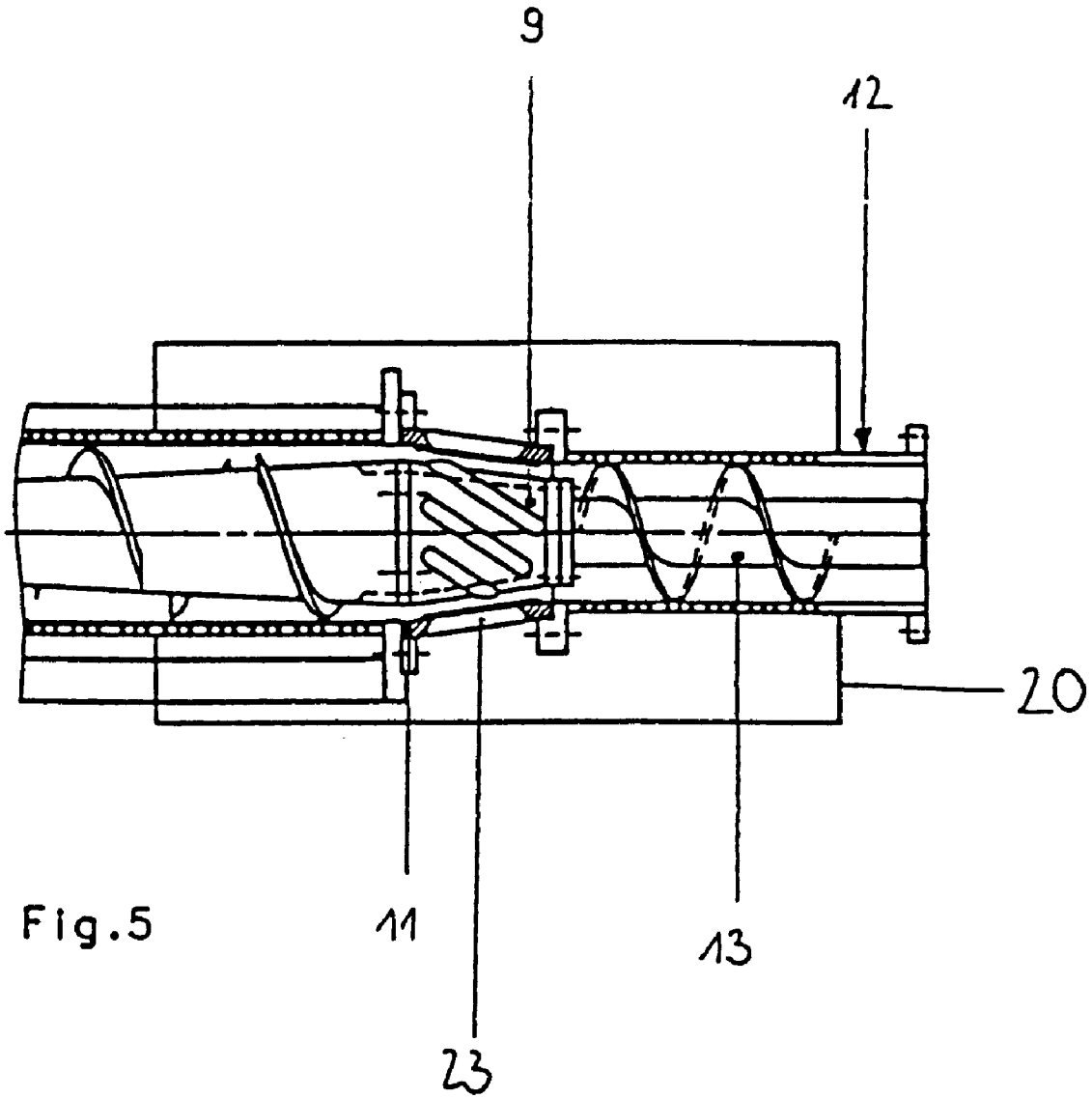
FIG. 5 shows a detail illustrating the grooves for steam recirculation.

As an alternative, the steam can also be distributed along grooves in the conical parts, thus preventing any heat loss. One such alternative to the arrangement in FIG. 4 is shown in FIG. 5, where the steam is re-circulated along grooves 23 in the conical casing 11.

The invention is not limited to the examples shown. On the contrary, it covers, for example, rounded cross-sections on the defibrating ribs, as well as angular cross-sections. It would also be possible to use a shaft with a constant diameter, rotating in a screen basket which converges in a conical shape.

What is claimed is:

1. Device for dewatering and defibrating lingo-cellulose material using a rotatable dewatering screw in which the material is dewatered and compacted and which is directly followed by defibrating elements defining a refining gap therebetween, wherein the improvement comprises that a said defibrating element is rigidly connected to the dewatering screw for co-rotation therewith and said defibrating element has a conical shape which decreases in diameter along the flow direction of the material.

2. Device according to claim 1, wherein the defibrating element contains ribs.

3. Device according to claim 2, wherein the ribs are mounted at an angle to the rotation axis of the screw.

4. Device according to claim 3, wherein the conical defibrating element is surrounded by a conical casing.

5. Device according to claim 2, wherein the conical defibrating element is surrounded by a conical casing.

6. Device according to claim 1 wherein the conical defibrating element is surrounded by a conical casing.

7. Device according to claim 6, wherein the conical casing has internal ribs.

8. Device according to claim 7, wherein the ribs form an angle to the rotation axis of the screw.

9. Device according to claim 6, wherein the conical casing is movable axially along the rotation axis of the screw.

10. Device according to claim 6, wherein the conical casing has openings for draining liquid expressed during defibrating.

11. Device according to claim 6, wherein said dewatering screw constitutes a first screw having a first shaft, and a second screw having a second shaft rigidly extends from the defibrating element coaxially with said first screw.

12. Device according to claim 11, wherein a pressure casing is mounted over the second screw, the defibrating element, and a portion of the first screw.

13. Device according to claim 12, wherein at least one of the defibrating element and the conical casing contains grooves to recirculate steam.

14. Device according to claim 1, wherein the defibrating element and the screw shaft are movable axially along the rotation axis of the screw.

15. Device according to claim 14, wherein the conical defibrating element is surrounded by a conical casing.

16. Device according to claim 1, wherein said dewatering screw constitutes a first screw having a first shaft, and a second screw having a second shaft rigidly extends from the defibrating element coaxially with said first screw.

17. Device according to claim 16, wherein said second shaft contains surface holes connected to an axial bore in the center of said second shaft.

18. Device according to claim 17, wherein the bore in the center of said second shaft continues through the defibrating element into the first shaft and is connected to openings at the surface of said first shaft.

19. Device according to claim 16, wherein a pressure casing is mounted over the second screw, the defibrating element, and a portion of the first screw.

20. Device according to claim 19, wherein the pressure casing is connected to a pipe containing means to pre-heat the material.

21. Device according to claim 19, wherein the defibrating element contains grooves to re-circulate the steam.

22. Device for dewatering and defibrating ligno-cellulose material as the material flows in a direction from input to output ends of the device, comprising:

a dewatering section having a screw formed on a screw shaft rotatable about a screw axis, and situated within a screw casing for dewatering and compacting the ligno-cellulose material; and a conical defibrating element rigidly extending from the screw shaft along the screw axis and having a diameter which decreases in the direction of material flow.

23. Device according to claim 22, wherein the conical defibrating element is surrounded by a conical casing.

24. Device according to claim 23, wherein the defibrating element and the screw shaft are movable axially along the rotation axis of the screw.

25. Device according to claim 23, wherein the conical casing is movable axially along the rotation axis of the screw.

26. Device according to claim 23, wherein the conical casing has openings for draining liquid expressed during defibrating.

27. Device according to claim 23, wherein said dewatering screw constitutes a first screw having a first shaft, and a second screw having a second shaft which rigidly extends from the defibrating element coaxially with said first screw.

28. Device according to claim 27, wherein the second shaft contains surface holes connected to an axial bore in the center of said second shaft; and the bore in the center of said second shaft continues through the defibrating element into said first shaft and is connected to openings at the surface of said first shaft.

* * * * *